US005379809A

United States Patent [19]

Waulk

[11] Patent Number: 5,379,809

[45] Date of Patent: Jan. 10, 1995

[54] WIRE TWISTING DEVICE

[76] Inventor: Robert M. Waulk, 3315 71st St. North, St. Petersburg, Fla. 33710

[21] Appl. No.: 134,890

[22] Filed: Oct. 13, 1993

[51] Int. Cl.[6] ..... B21F 7/00

[52] U.S. Cl. ..... 140/118; 140/149

[58] Field of Search ..... 140/118, 119, 149; 7/107, 108; 81/177.1

[56] References Cited

U.S. PATENT DOCUMENTS

| | | | |
|---|---|---|---|
| 2,739,623 | 3/1956 | Wirt | 140/149 |
| 3,333,609 | 8/1967 | Fielding | 140/119 |
| 3,438,413 | 4/1969 | Borah | 81/177.1 |
| 4,865,086 | 9/1989 | Robinson et al. | 140/118 |

FOREIGN PATENT DOCUMENTS

| | | | |
|---|---|---|---|
| 23683 | 2/1977 | Japan | 140/149 |

*Primary Examiner*—Lowell A. Larson
*Attorney, Agent, or Firm*—A. W. Fisher, III

[57] ABSTRACT

A wire twisting device and method to join the bare end portions of a plurality of insulated electrical wires together in a radially and longitudinally uniform spiral configuration to receive a hollow wire connector or nut on the outer end portions thereon, the wire twisting device comprises an insulated handle and wire twisting member wherein the wire twisting member includes a centrally disposed cavity formed therein having a plurality of protrusions extending inwardly toward the center thereof to cooperatively form a corresponding plurality of wire receiving channels between adjacent protrusions such that the bare end portions to be joined are placed in a corresponding channel whereby as the wire twisting device is rotated relative to the plurality of electrical wires the wire twisting device moves longitudinally relative to the insulated electrical wires to twist the bare end portions together to form the uniform spiral configuration prior to application of the hollow wire connector or nut thereon.

8 Claims, 1 Drawing Sheet

WIRE TWISTING DEVICE

BACKGROUND OF THE INVENTION

1. Field of the Invention

A wire twisting device and method to join the bare end portions of a plurality of insulated electrical wires to receive a wire connector or wire nut on the outer end portions thereof.

2. Description of the Prior Art

Wire nuts or wire connectors are used in electrical work to connect wires together. These fasteners are generally conically shaped and have either flanges or ribs that a worker can grip as the connector is applied. Unfortunately such wire connectors are small, tend to cause hand cramps and muscle fatigue after repeated installations. Proper connection torque is also difficult to achieve when numerous or heavy gauge wires are connected together.

A number of tools have been developed to apply a wire nut or wire connector directed to the bare ends of elecrical wires.

U.S. Pat. No. 3,769,862 describes a wire nut tool including a sleeve having an open end and an opposite connecting end, a first cavity in the sleeve proximate the open end sized to receive at least a portion of a wire nut and a second opening proximate the opposite end of the sleeve sized to receive a second wire nut. Slots are formed in the sidewalls of the sleeve proximate the open end for receiving the turning wings of a first wire nut and second slots are positioned in the sidewalls of the sleeve proximate the connecting end for receiving the turning wings of a second smaller sized wire nut.

U.S. Pat. No. 2,959,995 shows a wrench comprising a hollow, cylindrical socket member having work-engaging bores of different sizes in opposite ends, with means intermediate the ends of the socket providing a triangular hub portion in rigid concentric relation thereto for thumb and finger manipulation. The sides of the triangle are concave to define nonslip thumb and finger grip areas on the sides of the triangular hub.

U.S. Pat. No. 2,966,083 teaches a wrench for use with wire connectors of the pigtail type comprising a tapered body portion, arms outstanding from the large end of the body portion with amnually operable tabs on the arms and a central tapered fluted cavity open at both ends in the body portion to rotatively and releasably interlock with the exterior of a connector.

U.S. Pat. No. 4,823,650 describes a power driven wrench used to fasten and secure helical spring wire connectors consisting of a cone shaped plastic housing and a hexagonal shaft that extends outwardly from the bottom of the housing. The shaft is placed within a chuck of standard power tools such as power screwdrivers. The housing is open at the top and hollow inside to receive the connectors. Two slots are placed within the walls of the housing to receive and hold the wings or flanges of the connectors. Two slots are placed within the walls of the housing to receive and hold the wings or flanges of the connectors. A number of ribs, concentrically placed around the inner wall of the housing, engage ribs placed on certain types of connectors that have no flanges. The ribs prevent free rotation of the connector within the housing. A magnet embedded within the bottom of the housing holds the connector within the housing.

U.S. Pat. No. 3,902,005 shows a screw-on type wire connector comprising a housing tubular shell member closed at the distal end formed of a deformable insulating plastic material having an axial bore including a proximal inwardly tapered throat section joining an inwardly tapered intermediate section provided with longitudinally extending raised flats arranged in quadrature and joining by a tapered shoulder, a slightly tapered distal bore of reduced cross section. A tapered elongated helical wire coil nests in the housing bore with its narrow inner end force fitted in the distal bore and extending short of the closed end and the wire end of the coil engaging and distorting the flats in the intermediate bore section. Upon application to a pair of wires, the coil self-threads into the flat faces and distal bore faces.

U.S. Pat. No. 4,227,040 teaches a screw-on electrical connector containing a plastic insulating cap with a coil spring on the inside constructed and arranged to be screwed down on the stripped ends of two or more electric wires. The connector is constructed to provide a variable and controlled spring rate or compression load on the stripped ends of the largest number of wire combinations.

Re. 24,074 describes an electrical connector with means for connecting two conductor ends together comprising a hollow cylindrical splice cap, a plurality of electric conductors extending within the splice cap, the splice cap being deformable at spaced points to electrically and mechanically connect the conductors and to provide exterior depressions. A separable resilient insulating member extends over the splice cap and the ends of the conductors and is adapted to be applied over the splice cap after formation of the depressions. The insulating member has a section with a smooth cylindrical outer surface and a retaining member slidable over the section of the insulating member to a position over the depression where the retaining member forces a portion of the insulating member into firm engagement with the depressions to prevent accidental removal of the insulating member from the splice cap.

In addition, various wire twisting tools and machines have been designed to twist or join a plurality of wires.

U.S. Pat. No. 3,168,118 describes a wire twisting device comprising a head or tip with a shaft-like member. The head including means to seize a pair of crossed wires and twisting the wires in a uniform member.

U.S. Pat. No. 2,949,939 shows a wire splicer comprising an elongated U-shaped frame having spaced parallel end walls, a wire-clamping means and a rotary wire support means. The clamping means includes recesses for removably holding wires to be spliced. The rotary means including a shaft to provide a take-up for contraction of the wires and the shaft includes bores for receiving wires held by the clamping means whereby the wires are adapted to be intertwisted upon rotation of the shaft.

U.S. Pat. No. 3,026,915 teaches a wire twister capable of twisting wires of different sizes without the need of adjustment comprising a first rotataable member having a radially directed flange at one end, a pair of jaw members attached to one face of the flange, a pair of cam elements fixed to one face of the second flange and positioned to engage portions of the jaw members to urge them into wire gripping positions when the rotatable members are rotated and spring means to cause the cam elements to urge the jaws into wire-releasing positions.

U.S. Pat. No. 3,990,486 describes a device comprising a solid cylinder which will receive wire within grooves. The cylinder is removably received within a collar or sleeve, after which the extending loop is held and the assembly is rotated a number of times, which produces a twisted length of wire.

SUMMARY OF THE INVENTION

Typically a plurality of insulated electrical wires are loosely twisted together in electrical contact by a hollow wire nut or connector with limited electrical contact therebetween.

The present invention relates to a wire twisting device comprising an insulated handle and a wire twisting member to join a plurality of insulated electrical wires having the bare end portions tightly twisted in a uniform spiral configuration before application of the hollow wire connector or nut.

The insulated handle comprises a hand grip having a guard formed on the inner or distal end constructed of hard plastic with a rubber coating or similar insulating material.

The wire twisting member comprises a reduced proximal element including a substantially cylindrical portion and an enlarged distal element including an outer substantially cylindrical portion and an inner substantially frustrum conical portion.

A centrally disposed cavity is formed in the wire twisting member to receive the bare end portions of the insulated electrical wires including an inner inverted substantially frustrum conical portion and an outer substantially conical portion. A plurality of tapered protrusions each extend inwardly into the centrally disposed cavity to cooperatively form a corresponding plurality of peripheral wire receiving channels between adjacent tapered protrusions and a centrally disposed channel.

To use, the user grasps the hand grip and places the bare end portions of a plurality of insulated electrical wires in the centrally disposed cavity such that each individual bare end portion is disposed in one of the wire receiving peripheral channels with the plurality of insulated electrical wires and corresponding bare end-portions disposed in substantially parallel relationship relative to each other. With the insulated electrical wires so operatively positioned, the user rotates the wire twisting device whereby the bare end portions are twisting together from the individual tips thereof toward and through the proximal portions of each insulated electric wire pushing the twisted bundle of joined insulated electric wires longitudinally outward relative to the wire twisting device through the centrally disposed channel. The guard protects the user's hand grasping the hand grip when positioning or inserting the bare end portions and proximal portions into the centrally disposed cavity.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
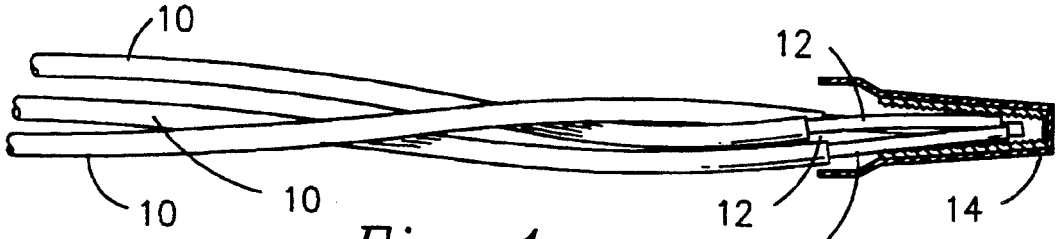
FIG. 1 is a side view of a plurality of electrical wires joined by the wire nut or connector operatively coupled thereto.

FIG. 1 shows a plurality of insulated electrical wires each indicated as 10 having the bare end portions 12 loosely twisted together in electrical contact by a hollow wire nut or connector 14. As shown, when the hollow wire nut or connector 14 is employed to join the bare end portions 12 there is limited electrical contact therebetween. In addition, the insulated portion of the insulated electrical wires 10 are not twisted together. Moreover, when joining relatively heavy wire conductors such as 12 gauge to 8 gauge the hollow wire nut or connector 14, if not ineffective in twisting the bare end portions 12 together, are difficult to apply.

Figure 2:
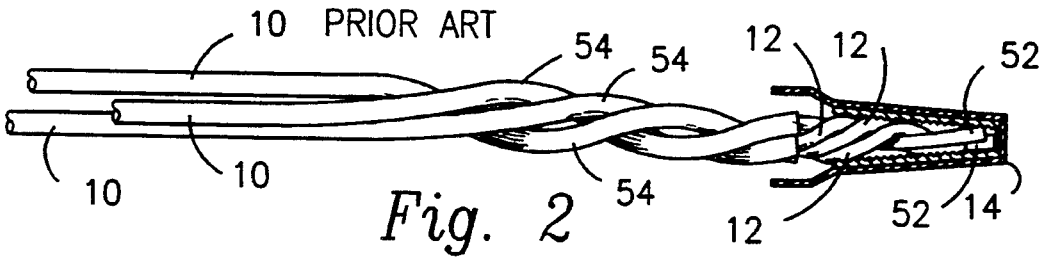
FIG. 2 is a side view of a plurality of electrical wires joined by the wire twisting device of the present invention with a wire nut or connector operatively coupled thereto.
Figure 3:
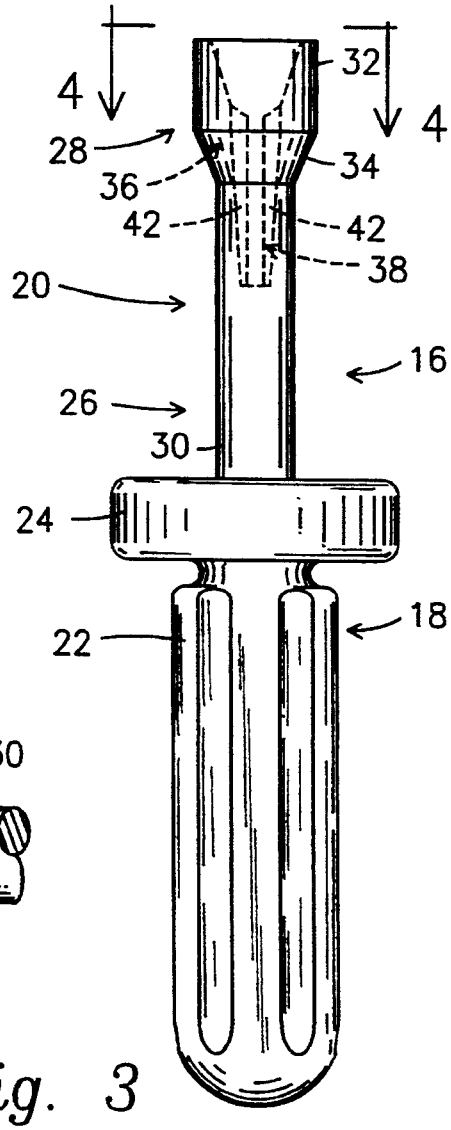
FIG. 3 is a side view of the wire twisting device of the present invention.

In contrast, FIG. 2 shows a plurality of insulated electrical wires 10 having the bare end portions 12 tightly twisted in a uniform spiral configuration with the wire twisting device of the present invention generally indicated as 16 before application of the hollow wire connector or nut 14. As shown in FIG. 3, the wire twisting device 16 comprises an insulated handle generally indicated as 18 and a wire twisting member generally indicated as 20.

As shown in FIG. 3, the insulated handle 18 comprises a hand grip 22 having a guard 24 formed on the inner or distal end thereof. Both the hand grip 22 and guard 24 may be constructed of hard plastic with a rubber coating or similar insulating material.

Figure 4:
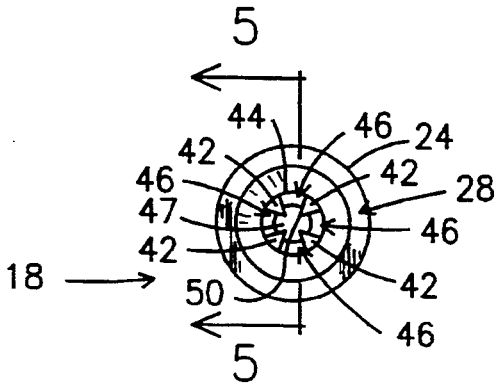
FIG. 4 is an end view of the wire twisting device of the present invention taken along line 4—4 of FIG. 3.
Figure 5:
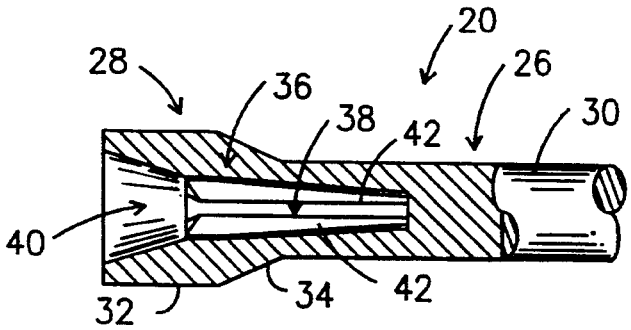
FIG. 5 is a partial cross-sectional side view of the wire twisting device of the present invention taken along line 5—5 of FIG. 4.

As shown in FIGS. 3 through 5, the wire twisting member 20 comprises a reduced proximal element generally indicated as 26 and an enlarged distal element generally indicated as 28. The reduced proximal element 26 comprises a substantially cylindrical portion 30; while, the enlarged distal element 28 comprises a first or outer substantially cylindrical portion 32 and a second or inner substantially frustrum conical portion 34 disposed between the substantially cylindrical portion 30 and the first substantially cylindrical portion 32.

A centrally disposed cavity generally indicated as 36 is formed in the wire twisting member 20 to receive the bare end portions 12 of the insulated electrical wires 10 as described hereinafter. More specifically, the centrally disposed cavity 36 comprises an inverted funnel shaped bore including an inner inverted substantially frustrum conical portion 38 extending from the first outer substantially cylindrical portion 32 through the second or inner substantially frustrum conical portion 34 and into the substantially cylindrical portion 30 and an outer substantially conical portion 40 formed in the first or outer substantially cylindrical portion 32. A plurality of tapered protrusions each indicated as 42 extend inwardly from the side wall 44 of the inner inverted substantially frustrum conical portion 38 to cooperatively form a corresponding plurality of peripheral wire receiving channels each indicated as 46 between adjacent tapered protrusions 42 and a centrally disposed channel 47. As best shown in FIG. 4, each tapered protrusion 42 comprises a cross-section decreasing from the intersection 48 with the side wall 44 to the inner end 50 thereof.

To use, the user grasps the hand grip 22 and places the bare end portions 12 of a plurality of insulated electrical wires 10 in the centrally disposed cavity 36 such that each individual bare end portion 12 is disposed in one of the wire receiving peripheral channels 46 with the plurality of insulated electrical wires 10 and corresponding bare end portions 12 disposed in substantially parallel relationship relative to each other. With the insulated electrical wires 10 so operatively positioned, the user rotates the wire twisting device 16 whereby the bare end portions 12 are twisting together from the individual tips 52 thereof toward and through the proximal portions 54 of each insulated electric wire 10. As the wire twisting device 16 is rotated, the bare end portions 12 and corresponding insulated portions move inwardly and pass through the spaces formed between the inner ends 50 of adjacent tapered protrusions 42 into the centrally disposed channel pushing the twisted bundle of joined insulated electric wires 10 longitudinally outward relative to the wire twisting device 16 through the centrally disposed channel 47. The guard 24 protects the user's hand grasping the hand grip 22 when positioning or inserting the bare end portions 12 and proximal portions 54 into the centrally disposed cavity 36.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A wire twisting device to join the bare end portions of a plurality of insulated electrical wires together in a radially and longitudinally uniform spiral configuration to receive a hollow wire connector or nut on the outer end portions thereon, said wire twisting device comprises a wire twisting member including a distal and proximal end having a handle attached to the proximal end thereof, said wire twisting member including a centrally disposed frustrum conical cavity having an inclined inner side wall, said inclined inner side wall having a plurality of tapered protrusions each including an inner base and an outer edge comprising a cross-section decreasing from said inner base to said outer edge thereof extending from said inclined inner side wall to cooperatively form a corresponding plurality of wire receiving channels between adjacent tapered protrusions, said outer edges disposed in parallel relationship relative to each other to cooperatively form a centrally disposed cylindrically shaped channel therebetween, said wire receiving channels and said centrally disposed cylindrically shaped channel disposed parallel to each other such that the bare end portions to be joined are placed in a corresponding channel whereby as the wire twisting device is rotated relative to the plurality of electrical wires said wire twisting device moves longitudinally relative to the insulated electrical wires to twist the bare end portions together to form the uniform spiral configuration prior to application of the hollow wire connector or nut thereon.

2. The wire twisting device of claim 1 wherein said handle comprises a hand grip including a distal end having a guard formed on the distal end thereof.

3. The wire twisting device of claim 1 wherein said centrally disposed cavity includes an inner portion having a plurality of tapered protrusions each extending inwardly from the side wall thereof to cooperatively form a corresponding plurality of peripheral wire receiving channels between adjacent tapered protrusions to selectively receive the bare end portion of an individual insulated electrical wire.

4. The wire twisting device of claim 1 wherein said centrally disposed cavity further includes an outer portion comprising a conical configuration.

5. The wire twisting device of claim 4 wherein said centrally disposed cavity comprises an inverted funnel shaped bore.

6. The wire twisting device of claim 5 wherein said wire twisting member comprises a reduced proximal element and an enlarged distal element.

7. The wire twisting device of claim 6 wherein said reduced proximal element comprises a substantially cylindrical portion and said enlarged distal element comprises an outer substantially cylindrical portion and an inner substantially frustrum conical portion disposed between said substantially cylindrical portion and said first substantially cylindrical portion.

8. The wire twisting device of claim 7 wherein said inner inverted substantially frustrum conical portion extends from said first outer substantially cylindrical portion substantially conical portion is formed in said outer substantially cylindrical portion.

* * * * *